United States Patent [19]

Mir

[11] 4,168,118

[45] Sep. 18, 1979

[54] ELECTRONIC IMAGING APPARATUS USING MULTICOLOR ELECTROPHOTOSENSITIVE PARTICLES

[75] Inventor: José M. Mir, Webster, N.Y.

[73] Assignee: Eastman Kodak Company, Rochester, N.Y.

[21] Appl. No.: 821,114

[22] Filed: Aug. 2, 1977

[51] Int. Cl.[2] ..... G03G 15/01

[52] U.S. Cl. ..... 355/4; 96/1 PE; 355/3 P; 355/14

[58] Field of Search ..... 355/3 R, 3 P, 4, 14; 96/1 PE, 1.2; 204/299 PE, 300 PE

[56] References Cited

U.S. PATENT DOCUMENTS

| | | | |
|---|---|---|---|
| 3,121,375 | 2/1964 | Fotland et al. | 96/1.2 X |
| 3,682,628 | 8/1972 | Gundlach | 96/1 PE X |
| 4,009,466 | 2/1977 | Clark | 355/3 P X |

*Primary Examiner*—Fred L. Braun

*Attorney, Agent, or Firm*—John D. Husser

[57] ABSTRACT

Electronically controlled imaging with a multicolor mixture of photoconductive particles is effected in a single exposure cycle by provision of an addressable electrode array which is energized selectively in image-wise timed relation. The control device for the imaging system has a plurality of sensing elements for measuring the color density values of successive lines of an original to be reproduced and producing a signal in response to the density measurement to regulate the length of time that the electrode array is energized.

14 Claims, 5 Drawing Figures

ELECTRONIC IMAGING APPARATUS USING MULTICOLOR ELECTROPHOTOSENSITIVE PARTICLES

BACKGROUND OF THE INVENTION

1. Field of the Invention

The present invention relates to photoelectrophoretic migration imaging and in particular to apparatus for implementing such imaging in response to electronic signals representative of an original.

2. Description of the Prior Art

Photoelectrophoretic migration imaging involves the light image exposure of a liquid suspension, comprising dielectric liquid carrier and photoconductive toner particles, while between two electrodes that provide a migration inducing field. U.S. Pat. No. 3,140,175 to Kaprelian discloses early procedures and apparatus of this type. In operation, the suspended toner particles attain a charge and migrate from the suspension to one of the electrodes. Upon exposure the illuminated particles migrate to the other electrode in accordance with the exposing light image pattern. Various embodiments for photoelectrophoretic migration imaging have been subsequently proposed (see, e.g., Tulagin, U.S. Pat. No. 3,384,565). Recently a photoimmobilized electrophoretic migration imaging method has been described wherein the light-exposed, photoconductive toner particles are retained at the electrode to which they first migrate and unexposed particles change charge and migrate to the other electrode (see, e.g., U.S. Pat. No. 3,976,485).

Certain difficulties have arisen during efforts to commercialize such photoelectrophoretic migration imaging systems. For example, high density images are difficult to attain in such systems. Further, in color imaging using this technique, it would be useful to have capabilities for color adjustment. Since the image density is dependent in part on light intensity, filtering to achieve color adjustment is not a desirable approach. Also, it is envisioned that office systems of the future may utilize image transmission, and it is not apparent how optically-addressed copiers of the type described above can accommodate such a future need.

In view of one or more of the problems and/or desired capabilities noted above, there have been described in literature proposals for electrically-addressable photoelectrophoretic imaging systems. For example U.S. Pat. No. 3,663,396 and British Pat. No. 1,341,690 respectively disclose electronic address of a color cathode ray tube and an electroluminescent panel used as the exposure source for such an imaging system. These approaches offer the potential for improved density, color adjustment and electronic transmission of images; however, the exposure elements are fragile and costly. The complicated control systems for addressing the exposure elements add another large factor of cost so that such proposed systems would be quite expensive.

A somewhat simpler approach is disclosed in U.S. Pat. No. 3,682,628 wherein a point light source is scanned, line by line, across the photoelectrophoretic suspension, through a transparent electrode. The opposite electrode is selectively energized, in accordance with a video signal representative of the image to be formed, and photoconductive particles in suspension are selectively activated on coincidence of the point light source and an energized condition of the electrode. However, this system cannot provide color separation, so that separate exposures of separate mono-particle suspensions to form three different color separation images (e.g., cyan, magenta and yellow) are required. This requires additional equipment and time as compared to conventional tri-particle suspension systems. Additionally, the procedure requires registry of three images during transfer, and such transfer is extremely difficult to accomplish accurately.

SUMMARY OF THE INVENTION

It is an object of the present invention to provide improved apparatus for photoelectrophoretic imaging.

More specifically it is an object of the present invention to provide such apparatus which can be electronically-addressed and thus afford advantage in image density, color adjustment and/or image transmission capability over prior art apparatus.

Another object of the present invention is to provide such an electronically-addressed imaging apparatus which affords advantage in simplicity and cost.

The above and other objects and advantages are afforded in accordance with the present invention by providing a plurality of separately-addressable electrodes spaced across the exposure zone that are selectively energized in accordance with image information and which cooperate with a plurality of light sources which provide sequential series of differently-colored light pulses. The suspension at the image zone can thus be addressed, line by line, with appropriate color-separation information for each picture element on the line.

BRIEF DESCRIPTION OF THE DRAWINGS

The invention is hereinafter described in connection with the attached drawings which form a part hereof and in which.

DETAILED DESCRIPTION OF THE PREFERRED EMBODIMENTS

Figure 1:
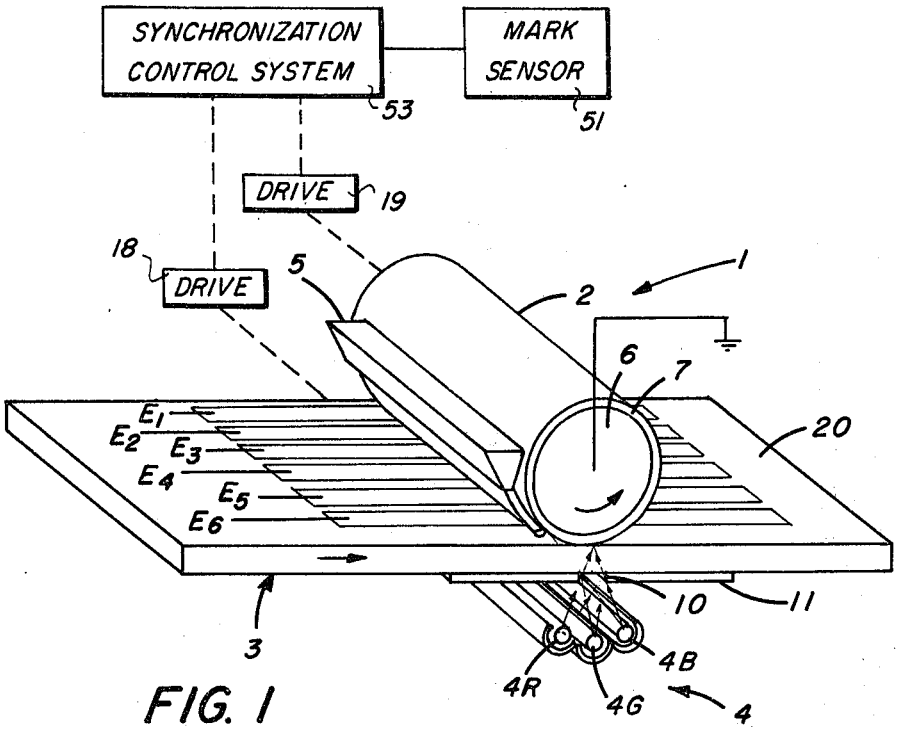
FIG. 1 is a perspective schematic view of an imaging station in accordance with one embodiment of the present invention.

Referring to FIG. 1, one embodiment of imaging station 1 in accordance with the present invention comprises a cylindrical imaged electrode 2, addressing electrode means 3 and illumination means 4. The imaged electrode 2 can be of a type known in the art and include an electrically-conductive core 6, coupled to ground, and an outer peripheral dielectric layer 7. The external surface of layer 7 can be used as the imaged surface, i.e., the surface on which the utilized image is formed, and the photoconductive toner image formed thereon can be transferred to another sheet or fixed directly to layer 7 (in the latter instance the layer 7 could be removably secured to the core 6). Suspension supply means 5, of a type known in the art, such as an extrusion hopper can be provided for supplying a uniform layer of photoelectrophoretic imaging suspension on electrode 2 or electrode 3.

The illumination means can comprise separate elongated sources $4_R$, $4_G$ and $4_B$ for providing, respectively, pulses of a different wavelength radiation, e.g., red, green and blue light. It will be appreciated that other types of electromagnetic radiation in the visible or adjacent ranges can be utilized if the particles respond thereto and the term "light" is used herein to include all such radiation. Each source desirably can include means such as a reflector for directing illumination therefrom onto an exposure slit 10 defined, e.g., by opaque mask 11, and extending transversely across the copying path.

Imaged electrode 2 is mounted for rotation about a fixed axis at a position such that portions of its peripheral surface, i.e., the external surface of layer 7, successively pass a position opposite exposure slit 10. Mounted for movement along a path so that successive transverse portions thereof pass between imaged electrode 2 and mask 11 is imaging electrode means 3. In the illustrated embodiment the imaging electrode means comprises an electrically-insulative matrix 20 which supports a plurality of elongated addressing electrodes $E_1$, $E_2$ . . . $E_6$ which are arranged in parallel orientation extending in the direction of electrode movement, generally orthogonal to exposure slit 10. The addressing electrodes desirably are substantially light transparent, electrically isolated from one another by matrix 20 and extend for a distance at least as great as a dimension of a document to be reproduced. In certain applications it may be desirable to overcoat the electrodes with a dielectric material, e.g., silicon monoxide or silicon dioxide, to prevent air breakdown between adjacent electrodes. The resolution of the reproduction produced by a particular image station will depend in part on the electrode size and spacing distance so that they are desirably narrow and closely spaced, e.g., 100–200 per inch. However, it will be appreciated that embodiments in which the electrode concentration is less than 100 per inch will be useful in some applications for example low resolution visual displays. The exposure slit can substantially be the same width at the electrodes; however, in some embodiments it may be desirable to have a larger slit dimension. The electrodes and exposure slit shown in FIG. 1 are larger than would be used in most applications for purpose of illustration. During imaging each addressing electrode is selectively energized to a voltage level in accordance with successive portions of an image pattern to be reproduced and in cooperation with the light pulses from source 4 provide controlled deposition of the photoconductive particles in the tri-particle suspension 22 which are at exposure slit 10.

A brief description of one mode of operation of the image station thus far described is believed useful before proceeding to the description of the apparatus which provides image and control signals to the image station. During operation a photoelectrophoretic suspension 22 is supplied at the nip between the imaged electrode 2 and the imaging electrode means 3. This can be accomplished by means known in the art, e.g., an extruding hopper for placing a layer on one of the electrodes at a location upstream from the nip. The addressing electrode 3 is moved past exposure slit 10 from left to right by drive means 18 and the imaged electrode 2 is rotated counterclockwise as viewed in FIG. 1 by drive means 19 so that successive portions of the imaged electrode surface move past the exposure slit. For purpose of explanation the surface of the imaged electrode 2 can be thought of as comprising a plurality of transverse strips or lines of width equal to the width of the exposure slit. In turn each transverse band can be considered as divided into a series of discrete segments, each defined by the projection of a portion of an addressing electrode on the transverse band. Each segment (formed by the successive coincidence of an electrode and the illuminated bands) forms a picture element, abbreviated herein "pixel". In accordance with the present invention each pixel is subjected to individual color separation imaging.

Figure 2:
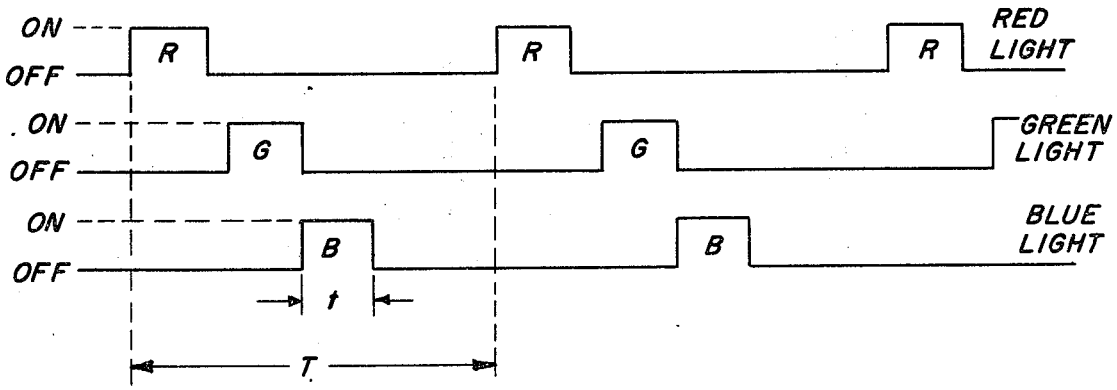
FIG. 2 is a diagram illustrating one embodiment for timing illumination with respect to electrode movement in accordance with the present invention.

More specifically, referring to FIG. 2 in conjunction with FIG. 1, the time period which each transverse band passes over the exposure is schematically denoted T, the line period. Within each line period T the present invention contemplates at least three separate subperiods "t", during which each band or line is exposed respectively to three successive pulses of light of different wavelength, e.g., red, green and blue light from sources $4_R$, $4_G$ and $4_B$. The coincident occurrence, during an exposure period t, of an energized electrode and a light pulse will create deposition of suspension particles activated by that light wavelength on the aligned pixel of the imaged electrode 2. The coincidence of a light pulse and a non-energized addressing electrode results in no particle deposition.

Thus, if none of the addressing electrodes E were energized during an entire imaging cycle, i.e., rotation of electrode 2 through one revolution and with synchronous movement of electrode 20 from a left-most position to a right-most position, no particles would be deposited on any pixel of electrode 2, even though the illumination means 4 provided its three sequential exposure pulses during each of line periods T of the cycle. This is because particle migration will not occur in absence of an electrical field, even though the photoconductive particles are activated by the light pulses. However, if all electrodes were energized during (and only during) the red pulse subperiod t of each line period T in a copy cycle, only the photoconductive particles activated by the red light (e.g., cyan particles) would migrate to each pixel on the image electrode 2. Similarly if the electrodes were activated during the red and green subperiods, cyan and magenta particles would migrate to each pixel. If the electrode were energized during all three subperiods the yellow particles would also migrate in response to the coincidence of addressing electrodes energization with blue light exposure.

Thus it will be appreciated that by proper control of the time of energization of each addressing electrode, in relation with the three sequential exposing light pulses t which occur during each line period T, the tricolor photoelectrophoretic suspension can be caused to migrate and form a color separation image.

Figure 3:
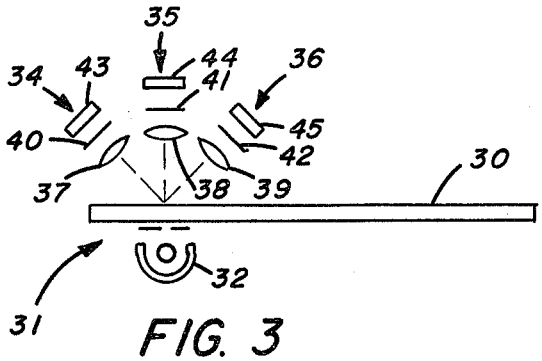
FIG. 3 is a schematic side view of one original scanning station in accordance with the present invention.
Figure 4:
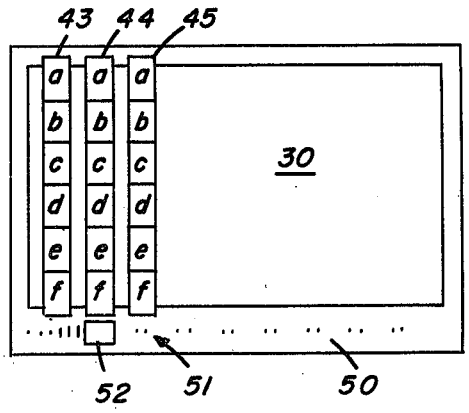
FIG. 4 is a schematic top view of the scanning station shown in FIG. 3.
Figure 5:
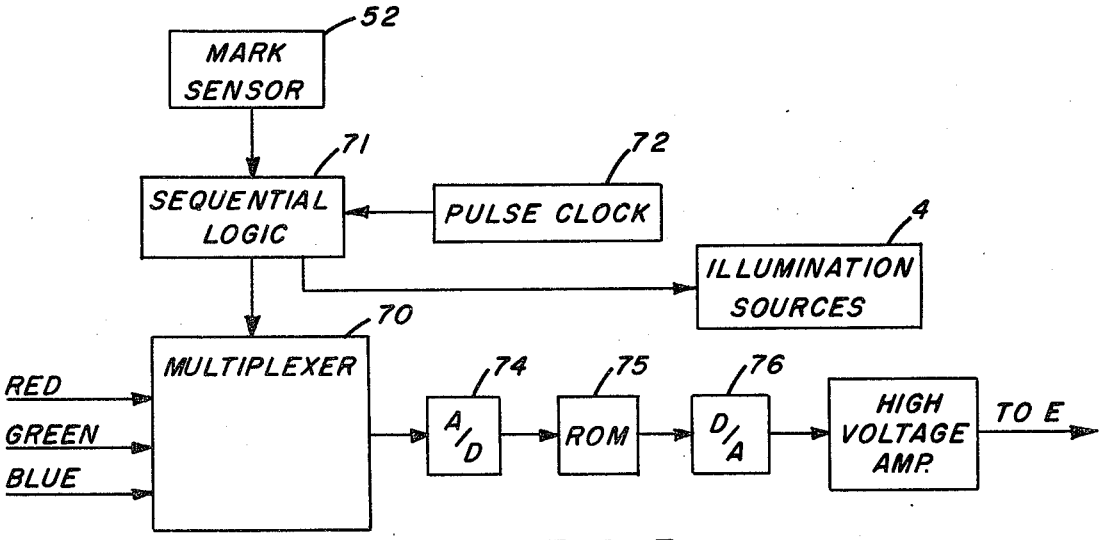
FIG. 5 is a block diagram illustrating one embodiment of control for the apparatus shown in FIGS. 1–4.

Referring now to FIGS. 3–5, an embodiment is illustrated for providing image information to the addressing electrodes E of image station 1, in response to scanning of a color original. As shown in FIGS. 3 and 4, the original 30, e.g., a photographic color negative transparency, is moved past a scanning station 31. The scanning station can comprise a panchromatic light source 32 and separate photosensor systems 34, 35 and 36 located on the opposite side of the original. To provide color separation information, each photosensor system respectively includes, a lens 37, 38 and 39, a color filter 40, 41 and 42 and a photocell 43, 44 and 45. The filter-photocell combination of each system is selected to provide information as to a different color separation component of the portion of original passing thereunder. For example, light from lamp 32 color modulated by the original 30, is focused by lens 37 onto photocell 43 passing through filter 40. Assuming system 34 to be a red color information sensor, the filter 40 is a red filter and the photocell 43 is red-light sensitive. Sensor systems 35 and 36 can similarly be formed as green and blue information sensors respectively. As shown in FIG. 4, each of the photosensors 43, 44 and 45 respectively comprises a plurality of discrete photosensors 43*a*, 43*b* . . . 43*f* corresponding in number to the number of addressing electrodes $E_1$, $E_2$ . . . $E_6$ of the imaging station 1. Each of the discrete sensors 43*a–b*, 44*a–b*, and 45*a–b* detects color information from a pixel element of the original, one line at a time.

As shown in FIG. 4, the original 30 is supported for movement past the photosensor systems on a transparent platen 50 having timing marks 51 thereon. A detector 52 is supported in alignment with the path of movement of the timing marks, and can include, e.g., a light source on one side of platen 50 which directs light through the timing marks to a photocell on the other side. Similar detection marks can be placed on electrodes 2 and 3 and the signals fed to a control system 53, for example such as disclosed in copending U.S. application Ser. No. 413,465, now U.S. Pat. No. 4,044,248, entitled METHOD AND APPARATUS FOR LINEARIZING A MIRROR GALVANOMETER and filed Nov. 11, 1973 in the name of David M. Glassman, for maintaining movement of the original and the electrodes in synchronization. It is essential that the imaged electrode 2 be moved in optical synchronism with the movement of the original and various other synchronization techniques known in the art can be utilized to accomplish this result. In a preferred embodiment the imaging electrode 3 also is moved to provide zero relative velocity with respect to contiguous portions of electrode 2, however, this is not essential. It is of course necessary that the periods of energization and non-energization of addressing electrodes E be properly related to the movement of the original and imaged electrode and with respect to the three exposure pulses which occur during the line periods T of those elements.

For this purpose, a control circuit such as disclosed in FIG. 5 can be provided. As indicated in that figure the red, green and blue light intensity signals generated by a set of photosensors, e.g., 43*a*, 44*a* and 45*a* (FIG. 4) associated with a corresponding linear electrode, e.g., $E_1$ (FIG. 1), are directed to the input terminals of a conventional multiplexer logic package 70. The multiplexer 70 is controlled by a sequential logic device 71 such as a shift register, counter or flip flop, which provides sequentially three digital selection signals that control the successive output of the red, green and blue light intensity signals from multiplexer 70. A pulse clock 72 provides a series of synchronizing timing pulses to device 71 which resets to an inactivating condition after each series of red, green and blue outputs and remains inactive until the mark sensor 52 signals the commencement of another output of color information for the next successive line of the original. As shown, the device 71 also provides sequential digital signals to the light sources $4_R$, $4_G$ and $4_B$ to control sequential actuation of the red, green and blue sources in synchronism with the red, green and blue color information output from the multiplexer 70.

Upon output from the multiplexer 70, the analog signal representative of the intensity, e.g., red light intensity of a pixel, is converted by an analog-to-digital converter 74 to a digital signal representative of the range of intensity within which the signal resides. This red intensity digital signal addresses a read only memory 75 which, in response provides to digital-to-analog converter 76 a digital signal indicative of the appropriate voltage to be impressed on the corresponding addressing electrode during the red light period t. That is, the extent of cyan particle deposition on imaged electrode 2 is proportional to the electrical field impressed during exposure, as well as to the intensity and quality of exposure. Therefore a tone scale for each color component can be provided by varying the field, i.e., the voltage impressed on an addressing electrode, with uniform intensity illumination.

Upon receipt of the next clock pulse, the green light intensity signal would be output from multiplexer 70 through the conversion circuitry, in synchronism with actuation of the green illumination source. Similarly in response to the third clock pulse, the blue light signal would be output; and the next subsequent clock pulse will reset device 71 to its initial condition, awaiting initiation of another activating sequence by mark sensor 52, when the original has advanced another line.

It will be appreciated that signal processing and timing circuitry described above will exist for each aligned R, G and B photosensor set and its corresponding electrode (i.e., 43*a*, 44*a*, 45*a* and $E_1$ . . . 43*f*, 44*f*, 45*f* and $E_6$). Also it will be understood that the color information of a particular type, e.g., red, green or blue, is transmitted in parallel to each pixel in a given line. That is, first the output of photosensors 43*a–f* will transmit the red information to the electrodes in synchronism with the red light pulse then the sensors 44*a–f* will transmit green information to the electrodes during the green light line exposure then sensors 45*a–f* will transmit the blue information to the electrodes during blue exposure. When this tricolor exposure sequence has been completed for each line of the original, a copy sequence is complete.

As an example of typical parameters for use in the present invention, at an electrode speed of 10 inches per second, with an electrode spacing of 10 electrodes per m.m. (75 $\mu$m electrode width and 25 $\mu$m gap) light exposures of about 40 mW/cm$^2$ and voltages in the range of 0–500 volts produced images having good color separation, density and sharpness.

It will be apparent that the cumulative time for each series of three exposure periods t must not exceed the line period T, which will be equal to the exposure slit width "W" divided by the velocity "V" of the imaged electrode surface. It is preferable, to obtain good color overlap, that $t << W/V$. This can be accomplished by proper selection of the clock pulse rate in conjunction with the rate of movement of the imaged electrode.

Although the invention has been described with respect to a particular embodiment it will be appreciated that significant modifications and a wide variety of alternative structures can be utilized for practice of the present invention.

For example with proper signal delay and signal proportioning circuitry the analog signals from the photocells could be input directly to the electrodes. Also in certain embodiments of the invention, tone scale might not be required and the read only memory and related converting circuitry could be eliminated. Further, if desired certain color correction functions could be effected by detecting qualities of the sensed original intensity signals electronically comparing those signals and providing compensation processing for the signals output to the electrodes.

Other devices and modes can be used for achieving a color tone variation, or gray scale, if desired. For example, the electrodes can be energized, during each pixel exposure period for each color of light, according to a variable duty cycle. That is, if a low density red component is desired for a pixel, the electrode might have a constant voltage energization but, for example, a 10% duty cycle during that particular red light exposure period for the pixel. Similarly, if high red density was desired the duty cycle might be, e.g., 90%. At electrode speeds of about 10 inches per second AC voltages of about 1000 Hz and 0–500 volts have been found useful for this mode of practicing the present invention. Similarly, a stepped voltage signal can be provided for address to the electrodes during each pixel color exposure period and the electrode selectively addressed by that signal during the stage of its period at which it is at the desired voltage level step. In practicing the invention in accordance with the two foregoing modified procedures it is possible in some instances to utilize an exposure slit larger than the desired pixel width without loss of resolution. That is, resolution can be controlled by the signal frequency.

With respect to the imaging station it will be appreciated that the structure herein described as the imaged and imaging electrodes could be reversed, i.e., the utilized image could be formed on the surface having the addressing electrodes. In that embodiment it would usually be essential that the rate of movement of the addressing electrodes be the same as the scanning rate of the original. However, signal storage means, e.g., a magnetic disc, could be provided if it were desired to operate in non-synchronous or off-line modes. It will of course be appreciated that the addressing electrode could be a cylindrical drum to facilitate continuous operation. Also, the addressing electrode could remain stationary and the light source move to effect the invention on successive suspension zones. If a separate transport web was utilized to move suspension over the exposure zone, the electrode structure could comprise simply a row of discrete addressable electrode pixels opposite the illumination source.

The illumination source could also take alternative forms. For example, chopped pulses could be provided by rotating a filter cylinder, having red, green and blue light filter sections, around the longitudinal axis of a constant panchromatic light source. The rotation of the cylinder would then be timed with respect to the address of the electrodes. Or, a multicolor filter array could be translated past the exposure slit at an appropriate rate to provide properly timed light pulses. Also, embodiments of the invention can be provided in which light is not projected through the addressing electrodes, e.g., by making the opposite electrode transparent.

The illustrated embodiment provided the imaged electrode at ground potential; however, this is not necessary as some applications may desirably utilize that electrode at a different potential level.

The invention has been described in detail with particular reference to certain preferred embodiments thereof, but it will be understood that variations and modifications can be effected within the spirit and scope of the invention.

I claim:

1. Apparatus for color imaging with a layer of a developer which contains electrophotosensitive pigment particles of different color types, respectively sensitive to light in different wavelength ranges, said apparatus comprising:

(a) illuminating means for uniformly exposing successive strips of such a developer layer respectively to series of time-separated light pulses, each series including different pulses respectively of light wavelength within the sensitivity range of one of said particle color types;

(b) addressable electrode means for selectively creating discrete migration fields along an illuminated strip of such developer layer; and (c) means for addressing said electrode means in an imagewise timed relation with respect to said light pulses.

2. The invention defined in claim 1 further including:

means for sensing a color original to be reproduced and for providing line-by-line electrical signals representative of the information on such original; and means for controlling said addressing means in accordance with said signals.

3. Apparatus for forming color images using a developer mixture of electrophotosensitive pigment particles of different color types, each type respectively being sensitive to light of different wavelength ranges, said apparatus comprising:

(a) means for providing successive series of time-separated, uniform light pulses, each such series illuminating an exposure strip, different pulses in each series uniquely corresponding in wavelength to the sensitivity range of one of said particle color types;

(b) addressable electrode means, aligned with said illuminating means, for forming a plurality of discrete, selectively energizable electrical fields located at close intervals along successively illuminated exposure strips;

(c) means for supplying successive quantities of such developer mixture respectively within successively illuminated exposure strips; and (d) control means for addressing said electrode means in timed relation with said light pulses to energize said discrete fields in accordance with the particular color image to be formed.

4. The invention defined in claim 3 further including means for sensing an original to be reproduced and signalling said control means in accordance with line-by-line color characteristics of said original.

5. The invention defined in claim 4 wherein said control means includes means for controlling the extent of electrode energization in accordance with the density characteristics of said original.

6. The invention defined in claim 3 further comprising second electrode means opposite said addressable electrode means and wherein said developer supplying means comprises means for forming a layer of such developer on one of said electrode means.

7. Apparatus for forming a multicolor image using a multicolor mixture of different particle types each having a distinct electrophotosensitivity, said apparatus comprising:

(a) illuminating means for providing repetitive series of sequential light pulses directed to uniformly illuminate an elongated exposing area, such series each comprising a plurality of different light pulses, respectively of different wavelength ranges which correspond to the photosensitivity of one of such particle type;

(b) an array of separately addressable, linear electrodes supported in closely spaced, substantially parallel and coplanar orientation;

(c) second electrode means, supported opposite said array, for providing a migration surface and field in cooperation with said array; and (d) control means for energizing each of said addressable electrodes in an imagewise timed relation with respect to said light pulses such that migration of illuminated mixture between said array and said second electrode means is effected in accordance with an image pattern.

8. The invention defined in claim 7 further comprising means for providing relative movement between said illuminating means and said array such that successive rows of transversely aligned pixels of said array are subjected in order to said series of pulses.

9. The invention defined in claim 8 wherein said control means includes means for sensing the color information of successive transverse lines of an original to be reproduced.

10. Apparatus for forming a multicolor image using a multicolor mixture of different particle types each having a distinct electrophotosensitivity, said apparatus comprising:

(a) means defining a strip exposure zone;

(b) means for providing successive quantities of such mixture at said exposure zone;

(c) illuminating means for providing repetitive exposure cycles, each including a plurality of sequential light pulses directed to uniformly illuminate said exposure zone, different light pulses in each of said cycles being of predetermined wavelength corresponding to the photosensitivity of one of such particle type;

(d) an array of separately addressable, electrodes located in closely spaced relation across said exposure zone;

(e) second electrode means, supported opposite said array;

(f) signal means for providing successive groups of parallel signals, each group comprising the information for one line of an image; and (g) control means responsive to said signals for energizing each of said addressable electrodes in an imagewise timed relation with respect to said light pulses.

11. The invention defined in claim 10 wherein said signal means includes means for sensing the color density values of successive lines of an original to be reproduced and said control means includes means for regulating the extent of energization of said electrodes in response to signals from said sensing means.

12. Apparatus for forming a color image using a color photoelectrophoretic suspension containing different photoconductive particle types, each type having unique color and light sensitivity characteristics, said apparatus comprising:

(a) an imaged electrode mounted for movement past an imaging zone;

(b) illuminating means for providing successive series of time-separated light strip pulses extending across said imaging zone, each series including at least one pulse of uniform light corresponding uniquely to the light sensitivity characteristic of one particle type of such suspension;

(c) an electrode array including a plurality of uniformly spaced linear electrodes each electrically insulated from the others and separately energizable, said electrodes being generally coplanar and being supported opposite said imaged electrode for movement past said imaging zone so that said light strip pulses from said illuminating means are generally transverse of said array;

(d) means for synchronizing the movement of said imaged electrode and the energization of said illumination means so that at least one series of pulses occurs per line of said image to be reproduced;

(e) signal means for providing successive groups of recording signals, each group containing the information for a line of the image to be reproduced; and (f) means for receiving such recording signals and for controlling the energization of said linear electrodes in synchronization with said light strip pulses and in accordance with said recording signals to effect line-by-line formation of a color image.

13. Apparatus for forming a color image using a color photoelectrophoretic suspension of the kind containing different photoconductive particle types that have distinct color and light sensitivity characteristics, said apparatus comprising:

(a) means defining a strip shaped imaging zone;

(b) a first electrode surface mounted for movement through said imaging zone;

(c) illuminating means for providing successive series of time-separated color pulses on said imaging zone, each series including pulses which individually activate respective particle types of such suspension;

(d) an electrode array comprising a plurality of closely spaced electrodes each electrically insulated from the others and separately energizable, said electrodes being opposite said first electrode at a location such that said pulses from said illuminating means extend across said array;

(e) signal means for providing successive groups of recording signals, each group containing the information for a line of the image to be reproduced; and (f) means for receiving such recording signals and controlling the energization of the electrodes in said array in synchronization with color pulses and in accordance with said recording signals to effect line-by-line formation of a color image.

14. Apparatus for forming a color image using a color photoelectrophoretic suspension of the kind containing different photoconductive particle types that have distinct color and light sensitivity characteristics, said apparatus comprising:

(a) means defining a strip-shaped imaging zone;

(b) a first electrode surface mounted for movement across the width of said imaging zone, the rate of such movement and width of said imaging zone establishing a line exposure period;

(c) illuminating means for providing successive series of time-separated light pulses on said imaging zone, each series including pulses of different colors which individually activate respective particle types of such suspension;

(d) an electrode array comprising a plurality of closely spaced electrodes each electrically insulated from the others and separately energizable, said electrodes being opposite said first electrode and aligned generally along the length of said imaging zone;

(e) means for supplying successive quantities of such suspension at said imaging zone during respective line exposure periods;

(f) signal means for providing successive groups of recording signals, each group containing the information for a line of the image to be reproduced;

(g) means for synchronizing energization of said illuminating means with movement of said first electrode surface so that at least one series of color pulses occurs during each line exposure period; and (h) means for receiving such recording signals and controlling the energization of the electrodes in said array in synchronization with color pulses and in accordance with said recording signals to effect line-by-line formation of a color image.

* * * * *